United States Patent [19]

Nagatomo et al.

[11] 4,021,244

[45] May 3, 1977

[54] SILVER HALIDE PHOTOGRAPHIC MATERIALS WITH SURFACE LAYERS COMPRISING BOTH ALKALI AND ACID PRODUCED GELATIN

[75] Inventors: Shigeru Nagatomo; Kiyotaka Hori, both of Minami-ashigara, Japan

[73] Assignee: Fuji Photo Film Co., Ltd., Minami-ashigara, Japan

[22] Filed: Apr. 17, 1975

[21] Appl. No.: 569,115

[30] Foreign Application Priority Data

Apr. 17, 1974 Japan ..... 49-42860

[52] U.S. Cl. ..... 96/67; 96/68; 96/69; 96/72; 96/73; 96/74; 96/114.7

[51] Int. Cl.[2] ..... G03C 1/76; G03C 3/00; G03C 1/02

[58] Field of Search ..... 96/114.7, 74, 67, 68, 96/69, 50 PL, 72, 73

[56] References Cited

UNITED STATES PATENTS

| | | | |
|---|---|---|---|
| 2,101,877 | 12/1937 | Sheppard et al. | 260/118 |
| 2,398,004 | 4/1964 | Houck et al. | 260/118 |
| 2,976,250 | 3/1961 | Walford | 96/114.7 |
| 3,507,678 | 4/1970 | Shimizu et al. | 96/67 |
| 3,551,151 | 12/1970 | Malan | 96/74 |

FOREIGN PATENTS OR APPLICATIONS

| | | |
|---|---|---|
| 1,334,397 | 10/1973 | United Kingdom |

OTHER PUBLICATIONS

"Gelatin," *Kirk–Othmer Encylc. of Chem. Techn.*, vol. 10, pp. 503–505, 1967, 2nd Ed.

"Gelatin Mixtures," *Research Disclosure*, Eastman Kodak, 9/1974, p. 21.

*Primary Examiner*—Edward C. Kimlin
*Assistant Examiner*—Richard L. Schilling
*Attorney, Agent, or Firm*—Sughrue, Rothwell, Mion, Zinn & Macpeak

[57] ABSTRACT

Silver halide photographic sensitive materials which comprise a surface layer containing acid treated gelatin and alkali treated gelatin, wherein the ratio by weight of the alkali treated gelatin to the acid treated gelatin is about 0.5 to less than about 100%.

14 Claims, No Drawings

SILVER HALIDE PHOTOGRAPHIC MATERIALS WITH SURFACE LAYERS COMPRISING BOTH ALKALI AND ACID PRODUCED GELATIN

BACKGROUND OF THE INVENTION

1. Field of the Invention

The present invention relates to silver halide photographic sensitive materials having improved physical properties and, particularly, to silver halide photographic sensitive materials having improved anti-adhesive properties in the surface layer thereof and excellent close adhesion between coated layers.

2. Description of the Prior Art

Silver halide photographic sensitive materials, generally, have a surface layer containing a hydrophilic colloid such as gelatin as a binder. Therefore, the adhesive property or tackiness of the surface of photographic materials increases in a high humidity-high temperature atmosphere with adhesion to other articles easily occurring on contact therewith. This adhesion phenomenon can happen between photographic materials themselves or between the photographic material and other articles during production, exposure, processing, projection or storage of the photographic materials to result in many disadvantages.

In order to solve this problem, a method of decreasing the adhesive property is known which comprises roughening the surface, the so called "matting", by adding fine particles having a particle size of about 0.3 to 5 $\mu$ selected from inorganic materials such as silicon dioxide, silver halide or titanium dioxide and organic materials such as polymethylmethacrylate to the surface layer. However, in this method, if improvement in the anti-adhesive property by adding a large amount of the matting agent is intended, there are defects that a uniform coating layer can not be obtained because aggregates form in the coating solution containing such a matting agent, that the photographic material is easily damaged because it has poor slipping properties, that the transparency of the resulting images is deteriorated and that the granularity of the images is injured.

Therefore, it has been desired to provide a means for improving the anti-adhesive property of the photographic materials without adding a large amount of the matting agent.

Since silver halide photographic materials generally contain not only silver halide emulsion layers but also photographic auxiliary layers such as an intermediate layer, a protective layer or an anti-halation layer, or a subbing layer positioned between these layers and the support thereof, these layers sometimes separate from each other by external mechanical action. These separation phenomena of the layers easily occur due to external mechanical action during photographing or during or after processing when adhesion between the coated layers themselves or between the coated layer and the support (hereinafter, designated close adhesion) is insufficient. Accordingly, improving the close adhesion without causing damage of the photographic properties and other physical properties has been required.

SUMMARY OF THE INVENTION

An object of the present invention is to provide photographic sensitive materials having improved anti-adhesive properties.

Another object of the invention is to provide photographic sensitive materials having excellent anti-adhesive properties and excellent close adhesion between the coated layers.

A further object of the invention is to provide photographic sensitive materials having excellent anti-adhesive properties in which adhesion difficulties during the production thereof are minimized.

It has now been found that the above described objects are attained by using acid treated gelatin together with alkali treated gelatin in the surface layer of the photographic sensitive materials, with the ratio by weight of the alkali treated gelatin to the acid treated gelatin being about 0.5 to less than about 100%.

DETAILED DESCRIPTION OF THE INVENTION

In this case, the surface layer can be the uppermost layer of the finished products or can be the uppermost layer of unfinished products during production. It is desired that the thickness of the surface layer in either embodiment is in a range of about 0.2 $\mu$ to 5 $\mu$ and preferably 0.5 $\mu$ to 3 $\mu$. The uppermost layer of the unfinished products becomes an intermediate layer which does not contain a photosensitive silver halide emulsion in the finished photographic sensitive materials. The unfinished product is a product in which the application of at least one additional layer is necessary in order to produce a finished product of a multi-layer photographic sensitive material. Herein, the application of layers includes both a process which comprises applying only one layer in one processing and a process which comprises applying two or more layers at the same time in one processing.

The photographic sensitive materials of the present invention are characterized by that acid treated gelatin and alkali treated gelatin are present in the surface layer. According to the present invention, photographic sensitive materials having a remarkably improved anti-adhesive property and remarkably improved close adhesion can be produced.

The acid treated gelatin used in the present invention is a gelatin which is produced by treatment with hydrochloric acid, etc. in the production from any collagenous stock, which is different from an alkali treated gelatin which is produced by treatment of any collagenous stock with lime conventionally used in the photographic industry. Processes for producing such gelatin and properties thereof have been described in detail in Arther Veis, *The Macromolecular Chemistry of Gelatin*, pages 187–217, Academic Press, (1964). Although differences appear in gel strength, swelling rate, dissolving rate, viscosity, the greatest difference in these gelatins is that the isoelectric point of the acid treated gelatin is a pH of about 6.0 to 9.5 while that of the alkali treated gelatin is a pH of about 4.5 to 5.3.

In the case of using acid treated gelatin together with alkali treated gelatin in the surface layer of the photographic sensitive materials, if the ratio of the alkali treated gelatin to the acid treated gelatin (by weight) is small, close adhesion is not improved. On the other hand, if the ratio is large, a smooth coating surface can not be obtained because aggregation of the coated materials occurs after application and drying. Accordingly, a preferred weight ratio of the alkali treated gelatin to the acid treated gelatin is in a range of about 0.5% to less than about 100% and particularly in a range of 5% to 80%. A process of using acid treated gelatin and alkali treated gelatin for photographic sensitive materials has been described in British Pat. No. 1,334,397. In this process, an improvement in accelerating a gelatin rate has been accomplished by using the alkali treated gelatin in an amount larger than the acid treated gelatin. However, the present invention is based on the discovery that the anti-adhesive properties and close adhesion are improved by using the acid treated gelatin in an amount of 0.5% or more but less than 100% to the alkali treated gelatin in the surface layer of the photographic sensitive material. Accordingly, the present invention is clearly distinguished from the method in the above described British patent.

In the present invention it is most important that the surface layer contains acid treated gelatin and alkali treated gelatin, but it is not always necessary that layers other than the surface layer contain both acid treated gelatin and alkali treated gelatin. The object of the present invention can also be attained by applying a layer containing acid treated gelatin and alkali treated gelatin as the surface layer of photographic sensitive materials having a conventional protective layer. The binder of the surface layer applied to the photographic sensitive materials used in the present invention can contain other hydrophilic binders in addition to the acid treated gelatin and the alkali treated gelatin. Particularly, enzyme treated gelatin produced by an enzyme treatment in the production of gelatin, the so-called gelatin derivatives, namely, those gelatins modified by processing with compounds having a group which is reactive with the functional groups in the gelatin molecule such as the amino groups, the imino groups, the hydroxyl groups or the carboxyl groups, and graft polymers produced by bonding molecular chains of other high molecular weight materials are suitably used in addition to the acid treated gelatin and the alkali treated gelatin.

As compounds for producing the above described gelatin derivatives, there are, for example, isocyanates, acid chlorides and acid anhydrides as described in U.S. Pat. No. 2,614,928, acid anhydrides as described in U.S. Pat. No. 3,118,766 bromoacetic acids as described in Japanese Patent Publication No. 5514/1964, phenylglycidyl ethers as described in Japanese Patent Publication No. 26845/1967, vinyl sulfone compounds as described in U.S. Pat. No. 3,132,945, N-aryl vinyl sulfonamides as described in British Pat. No. 861,414, maleinimide compounds as described in U.S. Pat. No. 3,186,846, acrylonitriles as described in U.S. Pat. No. 2,594,293, polyalkylene oxides as described in U.S. Pat. No. 3,312,553, epoxy compounds as described in Japanese Patent Publication No. 26845/1967, acid esters as described in U.S. Pat. No. 2,763,639, and alkane sultones as described in British Pat. No. 1,033,189.

Further, branching high molecular weight materials for grafting to gelatin have been described in U.S. Pat. Nos. 2,763,625, 2,831,767 and 2,956,884, *Polymer Letters*, 5, 595 (1967), *Phot. Sci. Eng.*, 9, 148 (1965) and *J. Polymer Sci.*, A - 1, 9, 3199 (1971), and polymers and copolymers of vinyl monomers such as acrylic acid, methacrylic acid, derivatives thereof such as their esters, amides or nitriles, and styrene etc., can be used. However, it is particularly preferred to use hydrophilic vinyl polymers having some compatibility with gelatin such as polymers and copolymers of acrylic acid, acrylamide, methacrylamide, hydroxyalkyl acrylate and hydroxyalkyl methacrylate.

Further, proteins such as colloidal albumin or casein, cellulose derivatives such as carboxymethyl cellulose or hydroxyethyl cellulose, agar agar, sodium alginate, dextran, gum arabic, saccharide derivatives such as starch derivatives, and synthetic hydrophilic colloids such as polyvinyl alcohol, poly-N-vinyl-pyrrolidone, poly-methacrylic acid copolymers, poly-methacrylamide and the derivatives or partially saponified products thereof can be used. If desired, a compatible mixture of two or more of these colloids can be used.

Although the mixing ratio of the acid treated gelatin and the alkali treated gelatin to these hydrophilic binders is not limited, it is preferred that the sum total of the acid treated gelatin and the alkali treated gelatin is above about 20% by weight and particularly above 40% by weight of all the binders of the surface layer. If the sum total of both the acid-treated gelatin and the alkali treated gelatin is below about 20% and enzyme treated gelatin or gelatin derivatives are not included as other binders, the coating solution is difficult to solidify by cooling after application and consequently it is difficult to obtain a uniform smooth coated surface.

The object of the present invention is suitably attained by using a matting agent in the surface layer containing at least acid treated gelatin and alkali treated gelatin. As the matting agent, particles of water insoluble organic or inorganic compounds having an average particle size of about 0.2 $\mu$ to 10 $\mu$ and preferably 0.3 $\mu$ to 5 $\mu$ are desirably used. Examples of organic compounds which can be suitably used include water dispersable vinyl polymers such as polymethyl acrylate, polymethyl methacrylate, polyacrylonitrile, acrylonitrile-$\alpha$-methylstyrene copolymers, polystyrene, styrenedivinylbenzene copolymers, polyvinyl acetate, polyethylenecarbonate or polytetrafluoroethylene, etc., cellulose derivatives such as methyl cellulose, ethyl cellulose, cellulose acetate or cellulose acetate propionate, etc., starch derivatives such as carboxy starch, carboxy nitrophenyl starch or urea-formaldehyde starch reaction products, gelatin hardened with known hardening agents, and hardened microcapsulated hollow particles of gelatin produced by coacervation. Examples of inorganic compounds which can be suitably used include silicon dioxide, titanium dioxide, magnesium oxide, aluminium oxide, barium sulfate, calcium carbonate, silver chloride and silver bromide, and glass, etc.

When these matting agents are added to the surface layer containing the acid treated gelatin and the alkali treated gelatin, the anti-adhesive properties are remarkably improved as compared with a case of using the matting agents together with only alkali treated gelatin and consequently it becomes possible to greatly decrease the amount of the matting agents, and thus photographic sensitive materials wherein images having excellent transparency and granularity are formed can be produced. The matting agent can be used in an amount of about 1 to 100 mg, preferably 5 to 30 mg, per gram of the total amount of binders of the surface layer.

As an auxiliary means for promoting further the effect of the present invention, a suitable amount of a hardening agent or a lubricating agent can be used together with the binders forming the surface layer. Addition of these gelatin additives to the surface layer of conventional photographic materials is well known as a means of further exhibiting the function of the surface layer, and thus it is preferred in the present invention to use such additives for the same purpose. Namely, hardening agents are effective for suitably hardening the surface layer to retain the physical strength of the surface layer. Examples of such hardening agents include aldehyde compounds such as formaldehyde or glutaraldehyde, ketone compounds such as diacetyl or cyclopentanedione, reactive halogen containing compounds such as bis-(2-chloroethylurea), 2-hydroxy-4,6-dichloro-1,3,5-triazine as well as the compounds as described in U.S. Pat. Nos. 3,288,775 and 2,732,303 and British Pat. Nos. 974,723 and 1,167,207, reactive olefin group containing compounds such as divinyl sulfone, 5-acetyl-1,3-diacryloylhexahydro-1,3,5-triazine as well as the compounds as described in U.S. Pat. Nos. 3,635,718 and 3,232,763 and British Pat. No. 994,869, N-methylol compounds such as N-hydroxymethyl phthalimide as well as the compounds as described in U.S. Pat. Nos. 2,732,316 and 2,586,168, isocyanates as described in U.S. Pat. No. 3,103,437, aziridine compounds as described in U.S. Pat. Nos. 3,017,280 and 2,983,611, acid derivatives as described in U.S. Pat. Nos. 2,725,294 and 2,725,295, carbodiimide compounds as described in U.S. Pat. Nos. 3,100,704, epoxy compounds as described in U.S. Pat. No. 3,091,537, isoxazole compounds as described in U.S. Pat. Nos. 3,321,313 and 3,543,292, halocarboxyaldehydes such as mucochloric acid, dioxane derivatives such as dihydroxydioxane, and inorganic hardening agents such as chromium alum or zirconium sulfate, etc. Further, precursors of hardner compounds such as alkali metal bisulfitealdehyde adducts, methylol derivatives of hydantoin or primary aliphatic nitroalcohol, etc. can be used instead of the above described compounds. These hardeners or hardener precursors can be used in an amount of about 2 to 80 mg, preferably 5 to 20 mg, per gram of the binders of the surface layer.

The lubricating agents are not only useful for preventing adhesion because they have a similar function to the matting agents but also are effective for improving the friction characteristics when used in a camera during photographing or upon projection of movie films. Examples of the lubricating agents suitably used include waxes such as liquid paraffin or esters of higher fatty acids, polyfluorohydrocarbons or derivatives thereof and silicones such as polyalkyl polysiloxanes, polyalkylaryl polysiloxanes or alkyleneoxide addition derivatives thereof, etc. These lubricating agents can be used in an amount of about 1 to 100 mg, preferably 10 to 50 mg, per gram of the binders of the surface layer.

Furthermore, surface active agents can be added alone or as a mixture of two or more thereof to a dispersion comprising the surface layer. Although they are generally used as coating assistants for preventing uneven coating, they can be utilized for other purposes such as for improvement of emulsification, prevention of the generation of electrostatic charges or prevention of adhesion of the finished photosensitive materials. These surface active agents can be classified as natural surface active agents such as saponin, nonionic surface active agents such as alkyleneoxide type, glycerin type or glycidol type agents, cationic surface active agents such as higher alkylamines, quaternary ammonium salts, pyridine or other heterocyclic compounds, phosphonium or sulfonium compounds etc., anionic surface active agents containing acid groups such as carboxylic acid, sulfonic acid, phosphoric acid, sulfuric acid ester or phosphoric acid ester groups, and amphoteric surface active agents such as aminoacids, aminosulfonic acids, or sulfuric or phosphoric acid esters of aminoalcohols, etc.

Some examples of surface active agents which can be used are described in U.S. Pat. Nos. 2,271,623, 2,240,472, 2,268,226, 2,739,891, 3,068,101, 3,158,484, 3,201,253, 3,210,191, 3,294,540, 3,415,649, 3,441,413, 3,443,654, 3,475,174 and 3,545,974, German Patent Publication (O.L.S.) 1,942,665, British Pat. Nos. 1,077,317, and 1,198,450, Ryohei Oda, *Kaimenkasseizai no Gosei to sono Oyo, Maki Shoten Co.* (1964), A. W. Perry, *Surface Active Agents*, Interscience Publications Incorporated (1958) and J. P. Sisley, *Encyclopedia of Surface Active Agents*, Vol. 2, Chemical Publishing Company, (1964). These surface active agents can be used in an amount of about 0.5 to 50 mg, preferably 1 to 20 mg, per gram of the binders of the surface layer.

Silver halide emulsions used in the present invention can be produced by mixing a solution of a water soluble silver salt (for example, silver nitrate) with a solution of a water soluble halogen salt (for example, potassium bromide) in a solution of a water soluble high molecular weight material such as gelatin. As the silver halide, not only silver chloride and silver bromide but also mixed silver halides such as silver bromochloride, silver iodobromide and silver iodobromochloride can be used. Particles of the silver halide can have any of a cubic system, an octahedral system or a mixed crystal form. The particle size and the particle size distribution thereof is not limited. These silver halide particles can be produced by known conventional methods, such as the so-called single jet or double jet process or a control double jet process. Further, two or more silver halide photographic emulsions previously produced can be mixed. Still further, the silver halide particles can have any crystal structure, for example, a homogeneous structure, a laminar structure wherein the interior and the surface have different properties, or the so-called conversion type silver halide particles as described in British Pat. No. 635,841 and U.S. Pat. No. 3,622,318. Furthermore, they can be those wherein a latent image is formed mainly on the surface of the particles or those wherein the latent image is formed in the interior of the particles. These photographic emulsions have been described in C. E. K. Mees and T. H. James, *The Theory of the Photographic Process*, 3rd Ed., MacMillan Co. New York, (1966) and P. Glafkides, *Chemie Photographique*, Paul Montel Co. Paris (1957), and they can be produced by various known processes such as an ammonia process, a neutral process or an acid process, etc.

After formation of such silver halide particles, they are washed with water in order to remove the by-produced water soluble salts (for example, potassium nitrate when silver bromide is produced with using silver nitrate and potassium bromide) from the system, and then they are subjected to heat treatment in the presence of a chemical sensitizing agent such as sodium thiosulfate, N,N,N'-trimethylthiourea, a thiocyanate complex salt of monovalent gold, a thiosulfate complex salt of monovalent gold, stannous chloride or hexamethylenetetramine, etc. to increase the sensitivity without coarsening the particles. These processes have been described in the above described literature for references.

The silver halide emulsions can also be chemically sensitized using conventional methods. As the chemical sensitizing agents, gold compounds such as chloroaurate or gold trichloride as described in U.S. Pat. Nos. 2,399,083, 2,540,085, 2,597,856 and 2,597,915, salts of noble metals such as platinum, palladium, iridium, rhodium or ruthenium as described in U.S. Pat. Nos. 2,448,060, 2,566,245, 2,566,263 and 2,598,079, sulfur compounds which form silver sulfide by reacting with silver salts as described in U.S. Pat. Nos. 1,574,944, 2,410,689, 3,189,458 and 3,501,313, and stannous salts, amines and another reducible materials as described in U.S. Pat. Nos. 2,487,850, 2,518,698, 2,518,698, 2,521,925, 2,521,926, 2,694,637, 2,983,610 and 3,201,254 can be used.

It is possible to add various compounds in order to prevent a reduction of sensitivity or generation of fog during production of the photosensitive materials, during storage thereof or during processing thereof. As such compounds, a large number of compounds are known, for example, 4-hydroxy-6-methyl-1,3,3a,7-tetrazaindene, 3-methyl-benzothiazole, 1-phenyl-5-mercaptotetrazole and many other heterocyclic compounds, mercury containing compounds, mercapto compounds and metal salts. Examples of compounds which can be used have been described not only in *The Theory of the Photographic Process*, supra, pages 344–349, but also in the following patents: U.S. Pat. Nos. 1,758,576, 2,110,178, 2,131,038, 2,173,628, 2,697,040, 2,304,962, 2,324,123, 2,394,198, 2,444,605–8, 2,566,245, 2,694,716, 2,697,099, 2,708,162, 2,728,663–5, 2,476,536, 2,284,001, 2,843,491, 2,886,437, 3,052,544, 3,137,577, 3,220,839, 3,226,231, 3,236,652, 3,251,691, 3,252,799, 3,287,135, 3,326,681, 3,420,668 and 3,622,681, and British Pat. Nos. 893,428, 403,789, 1,173,609 and 1,200,188. If desired, the photographic emulsions can be subjected to spectral sensitization or super sensitization using cyanine dyes such as cyanine, merocyanine or carbocyanine compounds or a combination of such cyanine dyes with styryl dyes. These color sensitization techniques are well known and have been described in, for example, U.S. Pat. Nos. 2,493,748, 2,519,001, 2,977,229, 3,480,434, 3,672,897, 3,703,377, 2,688,545, 2,912,329, 3,397,060, 3,615,635 and 3,628,964, British Pat. Nos. 1,195,302, 1,242,588 and 1,293,862, German Patent Publications (OLS) 2,030,326 and 2,121,780, Japanese Pat. Publications Nos. 4936/1968, 14030/1969 and 10733/1968, U.S. Pat. Nos. 3,511,664, 3,522,052, 3,527,641, 3,615,613, 3,615,632, 3,617,295, 3,635,721 and 3,694,217 and British Pat. Nos. 1,137,580 and 1,216,203, etc. These compounds can be selected depending on the purpose and use of photosensitive materials, such as the wave length range to be sensitized or sensitivity, etc.

The photographic emulsion layers and other layers above described can contain synthetic polymers, for example, a water dispersable vinyl polymer latex and particularly a compound which increases the dimensional stability of the photographic materials, individually or as a mixture of two or more thereof (different polymers) or together with a hydrophilic water permeable colloid. As such polymers, many compounds can be used, for example, as described in U.S. Pat. Nos. 2,376,005, 2,739,137, 2,853,457, 3,062,674, 3,411,911, 3,488,708, 3,525,620, 3,635,715, 3,607,290 and 3,645,740, and British Pat. Nos. 1,186,699 and 1,307,373, etc. Of these compounds, copolymers and homopolymers of alkyl acrylates, alkyl methacrylates, acrylic acid, methacrylic acid, sulfoalkyl acrylates, sulfoalkyl methacrylates, glycidyl acrylate, glycidyl methacrylate, hydroxyalkyl acrylates, hydroxyalkyl methacrylates, alkoxyalkyl acrylates, alkoxyalkyl methacrylates, styrene, butadiene, vinyl chloride, vinylidene chloride, maleic acid anhydride or itaconic acid anhydride are generally used. If desired, the so-called emulsified graft polymer latex produced by emulsion polymerization of a vinyl compound in the presence of a hydrophilic colloidal high molecular weight material can be used.

In addition, the photographic sensitive emulsion layers can contain color couplers. Such couplers include 4-equivalent type diketomethylene yellow couplers and 2-equivalent type diketomethylene yellow couplers, for example, the compounds as described in U.S. Pat. Nos. 3,415,652, 3,447,928, 3,311,476 and 3,408,194, the compounds as described in U.S. Pat. Nos. 2,875,057, 3,265,506, 3,409,439, 3,551,155 and 3,551,156, and the compounds as described in Japanese Patent Application (OPI) Nos. 26133/1972 and 66836/1973; 4-equivalent type or 2-equivalent type pyrazolone magenta couplers and imidazolone magenta couplers, for example, the compounds as described in U.S. Pat. Nos. 2,600,788, 2,983,608, 3,062,653, 3,214,437, 3,253,924, 3,419,391, 3,419,808, 3,476,560 and 3,582,322, Japanese Patent Publication No. 20636/1970 and Japanese Patent Application (OPI) 26133/1972; and $\alpha$-naphthol type cyan couplers or phenol type cyan couplers, for example, the compounds as described in U.S. Pat. Nos. 2,474,293, 2,698,794, 3,034,892, 3,214,437, 3,253,924, 3,311,476, 3,458,315 and 3,591,383, and Japanese Patent Publication Nos. 11304/1967 and 32461/1969. In addition, DIR couplers as described in U.S. Pat. Nos. 3,227,554, 3,297,445, 3,253,924, 3,311,476, 3,379,529, 3,516,831, 3,617,291 and 3,705,801 and German Patent Publication (OLS) 2,163,811 can be used.

The photographic sensitive emulsions can contain a hardening agent and a surface active agent. These agents can be selected from the above described chemical materials used for the surface layer containing the acid treated gelatin and the alkali treated gelatin. The hardening agent is effective for increasing the physical strength of the photosensitive emulsion layers or other layers by hardening suitably these layers. The surface active agent is used as a coating assistant for preventing uneven coating at application of the photosensitive emulsion or other layers. However, it is sometimes used for other purposes, for example, for emulsification, sensitization, improvement of photographic properties, prevention of the formation of electrostatic charges and prevention of adhesion of the finished photosensitive materials, or can be used together with other additives in order to promote its function.

These photographic emulsion layers, auxiliary layers and the surface layer are applied to substantially planar materials which do not undergo any large dimensional changes during processings, for example, rigid supports such as glass, metal or ceramics or flexible supports. Typical flexible supports are cellulose nitrate films, cellulose acetate films, cellulose acetate butyrate films, cellulose acetate propionate films, polystyrene films, polyethylene terephthalate films, polycarbonate films, or laminated products of these films, thin glass films and paper. Further, paper coated or laminated with baryta or α-olefin polymers, particularly, $C_2^{+}{}_{10}$ α-olefin polymers such as polyethylene, polypropylene or ethylene-butene copolymers, and plastic films as described in Japanese Patent Publication No. 19068/1972 wherein the surface was roughened so as to improve close adhesion to other high molecular weight materials and to improve printability can also be used with good results.

A transparent support or an opaque support can be selected from these supports depending on the purpose of the photosensitive materials. Further, not only colorless transparent supports but also colored transparent supports which were dyed by adding a dye or a pigment can be used. This has been practiced hitherto for X-ray films and is described in *J. SMPTE*, 67, 296 (1958). As the opaque support, intrinsically opaque materials such as paper, opaque films produced by adding a dye or a pigment such as titanium dioxide to transparent films, plastic films the surface of which was processed by the method described in Japanese Patent Publication No. 19068/1972, and light-intercepting paper or plastic films containing carbon black can be employed. A layer which is adhesive to the support and the photographic emulsion layer can be employed as a subbing layer, if the adhesive strength between these layers is insufficient. If desired, the surface of the support can be previously subjected to a corona discharge, a ultraviolet light application or a flame treatment, etc. in order to further enhance the adhesive property.

Each layer of the photographic sensitive material can be applied using various processes such as a dip coating process, an air knife coating process, a curtain coating process or an extrusion coating process using a hopper as described in U.S. Pat. No. 2,681,294. If desired, two or more layers can be applied at the same time by the process described in U.S. Pat. Nos. 2,761,791, 3,508,947, 2,941,898 and 3,526,528. Further, a spray process or a process comprising adhesion of a gelatinized laminar material can be utilized.

The present invention will be illustrated in greater detail by the following examples. However, the present invention is not to be construed as being limited to these examples. Unless otherwise indicated, all parts, percentages, ratios and the like are by weight.

EXAMPLE 1

To a cellulose triacetate support having a subbing layer, a red-sensitive silver halide emulsion layer, an intermediate layer, a green-sensitive silver halide emulsion layer, a yellow filter layer and a blue-sensitive silver halide emulsion layer which contained the additives described in Table 1 and a surface layer were applied in order to produce Samples 1 to 8. Alkali treated gelatin having an isoelectric point of pH of 4.9 was used as the binder of each layer excepting the surface layer. Acid treated gelatin having an isoelectric point of a pH of 9.0 and alkali treated gelatin having an isoelectric point of a pH of 4.9 were used in the ratios described in Table 2 as the binder of the surface layer.

Table 2

| Sample | Gelatin: Acid-Treated Gelatin (%) | Gelatin: Alkali-Treated Gelatin (%) |
|---|---|---|
| 1 | 100 | 0 |
| 2 | 95 | 5 |
| 3 | 80 | 20 |
| 4 | 60 | 40 |
| 5 | 50 | 50 |
| 6 | 40 | 60 |
| 7 | 20 | 80 |
| 8 | 0 | 100 |

After adding 20 mg of polymethyl methacrylate having an average particle size of 2.1 μ as a matting agent and 80 mg of the sodium salt of 2,4-dichloro-6-hydroxy-1,3,5-triazine as a hardening agent per gram of the binder, the mixture was applied to all samples in a dry film thickness of 1.5 μ and dried at a temperature of 25° C and a relative humidity of 50%. In Samples 6 and 7, the coated solution aggregated at drying after application and a smooth flat coating surface could not be obtained. Accordingly, the close adhesion test was carried out on Samples 1, 2, 3, 4, 5, and 8 only.

Table 1

| Component | Red-Sensitive Emulsion Layer* | Green-Sensitive Emulsion Layer* | Blue-Sensitive Emulsion Layer* | Intermediate Layer | Yellow Filter Layer** |
|---|---|---|---|---|---|
| Coupler | 4-Chloro-1-hydroxy-N-dodecyl-2-naphthamide (0.88 g/m²) | 1-(2,4,6-Trichlorophenyl)-3-[3-(2,4-di-t-amylphenoxy)-acetamido]benzamido-5-pyrazolone (0.75 g/m²) | 3'-(2,4-Di-t-amylphenoxyacetamido)-α-(4-methoxybenzoyl)-acetoanilide (1.31 g/m²) | — | — |
| Spectral Sensitizing Agent | bis-(9-Ethyl-5-chloro-3-β-hydroxyethyl)-thiacarbocyanine bromide (6.51 mg/m²) | bis-(9-ethyl-5-phenyl-3-ethyl)-oxycarbocyanine isothiocyanate (5.23 mg/m²) | — | — | — |
| Stabilizing Agent [1] | (8.19 mg/m²) | (7.71 mg/m²) | (6.50 mg/m²) | — | — |
| Hardening Agent [2] | (15 mg/m²) | (14 mg/m²) | (20 mg/m²) | (10 mg/m²) | (11 mg/m²) |
| Coating Asistant [3] | (42 mg/m²) | (51 mg/m²) | (67 mg/m²) | (56 mg/m²) | (63 mg/m²) |
| [4] | (53 mg/m²) | (64 mg/m²) | (84 mg/m²) | (71 mg/m²) | (80 mg/m²) |
| | *Silver halide emulsion: Silver iodobromide (silver iodide: 5.5 mol %) | | | | **Yellow colloidal Silver |
| Dry Film | | | | | |

Table 1-continued

| Component | Red-Sensitive Emulsion Layer* | Green-Sensitive Emulsion Layer* | Blue-Sensitive Emulsion Layer* | Intermediate Layer | Yellow Filter Layer** |
|---|---|---|---|---|---|
| Thickness | 5μ | 6μ | 5μ | 2μ | 2μ |

[1] 5-Hydroxy-7-methyl-1,3,8-triazaindolidine
[2] 2,4-Dichloro-6-hydroxy-1,3,5-triazine sodium salt
[3] Sodium p-dodecylbenzene sulfonate
[4] Sodium p-nonylphenoxypoly(ethyleneoxy)propane sulfonate The adhesion test was carried out as follows. A sample was cut into a 4 cm square and conditioned at a temperature of 30° C and a relative humidity of 90% for 2 days in a container. After conditioning, the cut samples were superposed so that the surface layer of one photosensitive material contacted the back layer of another photosensitive material, and they were conditioned for 24 hours under a pressure of 50 g/cm². Then the samples were separated and the area adhered was determined. Thus, the ratio of the adhered area was calculated as a percentage.

The close adhesion test was carried out as follows. After the samples were stored at a temperature of 25° C and a relative humidity of 60% for 7 days after application, they were subjected to the following color development, bleaching, water wash, fixation, water wash and stabilizing processing. At color development and fixation, a line was drawn crosswise on the coating surface of the wet sample with a sharp steel pen with a definite pressure, and the friction resistance of the coating surface was determined.

| | |
|---|---|
| Color Developing Solution | |
| Sodium sulfite | 2.0 g |
| Sodium Carbonate (monohydrate) | 30.0 g |
| Potassium Bromide | 2.0 g |
| Benzyl Alcohol | 5.0 g |
| Hydroxylamine Sulfate | 1.6 g |
| 4-Amino-3-methyl-N-ethyl-N-(β-hydroxyethyl)aniline | 4.0 g |
| Water to make | 1 liter |
| Bleaching Solution | |
| Sodium Salt of Iron-Ethylenediamine Tetraacetic Acid | 100.0 g |
| Potassium Bromide | 60.0 g |
| Ammonium Hydroxide (28% aq. soln.) | 50.0 ml |
| Glacial Acetic Acid | 25.0 ml |
| Water to make | 1 liter |
| Fixing Solution | |
| Sodium sulfite | 10.0 g |
| Sodium Thiosulfate | 200.0 g |
| Water to make | 1 liter |
| Stabilizing Bath | |
| Formalin (40%) | 10.0 ml |
| Water to make | 1 liter |

The processing temperature was 35° C and the processing time was as follows.

| | minutes |
|---|---|
| Color Development | 3 |
| Bleaching | 6 |
| Water Wash | 3 |
| Fixation | 6 |
| Water Wash | 3 |
| Stabilization | 3 |

The friction resistance was evaluated according to the following standards.

| Grade | Condition |
|---|---|
| A | Holes were easily made on the surface layer by rubbing the surface thereof using a steel pen and the surface layer easily came off of the blue-sensitive emulsion layer. |
| B | Holes were made on the surface layer by rubbing the surface thereof by using a steel pen, but peeling from the blue-sensitive emulsion layer was somewhat difficult. |
| C | No holes were made using a steel pen and peeling off was not observed. |

The adhesion area and friction resistance results on processing Samples 1, 2, 3, 4, 5 and 8 are shown in Table 3.

Table 3

| Sample | Adhesion Area (%) | Friction Resistance | |
|---|---|---|---|
| | | Color Development | Stabilization |
| 1 | 15 | A | A |
| 2 | 15 | A | B |
| 3 | 15 | C | C |
| 4 | 25 | C | C |
| 5 | 30 | C | C |
| 8 | 85 | C | C |

It is clear from Table 3 that the close adhesion is inferior although the anti-adhesive property is good, if the binder of the surface layer is composed of acid treated gelatin only, and the anti-adhesive property is inferior although the close adhesion is good, if the binder is composed of alkali treated gelatin only, while photosensitive materials having excellent close adhesion and excellent anti-adhesive property can be obtained, if acid treated gelatin is used together with alkali treated gelatin.

EXAMPLE 2

A red-sensitive silver halide emulsion layer, an intermediate layer, a green-sensitive sensitive silver halide emulsion layer, a yellow filter layer, a blue-sensitive silver halide emulsion layer and a surface layer were applied in this order to a cellulose triacetate support having a subbing layer in the same manner as in Example 1 but 1,3,5-triacryloyl perhydro-1,3,5-triazine was used as a hardening agent in the amount of 46 mg/m² for the red-sensitive silver halide emulsion layer, 43 mg/m² for the green-sensitive silver halide emulsion layer, 62 mg/m² for the blue-sensitive silver halide emulsion layer, 32 mg/m² for the intermediate layer and 33 mg/m² for the yellow filter layer. Then, a mixture in which 20% of the total gelatin of the blue-sensitive silver halide emulsion layer of Example 1 was substituted by acid treated gelatin having an isoelectric point of a pH of 6.5 was applied to form a blue-sensitive silver halide emulsion layer. The surface layer was formed using acid treated gelatin having an isoelectric point of a pH of 6.5, alkali treated gelatin having an isoelectric point of a pH of 4.9, polymethyl methacrylate having an average particle size of 2.1 μ as a matting agent in the amount shown in Table 4, and 1,3,5-triacryloylperhydro-1,3,5-triazine as a hardening agent in the amount of 25 mg per gram of the binder, and applying so that the film thickness of the surface layer after drying was 1.5 μ. Then, it was dried at a temperature of 25° C and a relative humidity of 50% to produce Samples 9, 10, 11, 12, 13 or 14.

Table 4

| Sample | Binder: Acid-Treated Gelatin | Binder: Alkali-Treated Gelatin | Matting Agent (polymethyl methacrylate mg/g of binder) |
|---|---|---|---|
| 9 | 100 | 0 | 0 |
| 10 | 100 | 0 | 20 |
| 11 | 100 | 0 | 100 |
| 12 | 80 | 20 | 0 |
| 13 | 80 | 20 | 20 |
| 14 | 80 | 20 | 100 |
| 15 | 0 | 100 | 0 |
| 16 | 0 | 100 | 20 |
| 17 | 0 | 100 | 100 |

The adhesion test and the close adhesion test of these samples were carried out in the same manner as Example 1. Results are shown in Table 5.

Table 5

| Sample | Adhesion Area | Friction Resistance (both color development and fixation) |
|---|---|---|
| 9 | 70 | A |
| 10 | 10 | A |
| 11 | 5 | A |
| 12 | 50 | C |
| 13 | 15 | C |
| 14 | 5 | C |
| 15 | 90 | C |
| 16 | 80 | C |
| 17 | 40 | C |

It can be understood from the results in Table 5 that photosensitive materials having an excellent anti-adhesive property and excellent close adhesion can be obtained by using acid treated gelatin together with alkali treated gelatin and that photosensitive materials having a remarkably excellent anti-adhesive property can be obtained if a matting agent is further added. In Sample 13, the anti-adhesive property is excellent and the transparency after the same processing as in Example 1 were carried out is excellent even though the amount of the matting agent in Sample 13 is less than that in Sample 17. Further, in Sample 12, where the matting agent was not added, the anti-adhesive property is superior to that of Sample 16 where the matting agent was added.

EXAMPLE 3

A silver halide emulsion layer and a protective layer were applied to both surfaces of a polyethylene terephthalate film support having subbing layers and the film was dried at a temperature of 25° C and a relative humidity of 60%. The protective layer was formed using acid treated gelatin having an isoelectric point of a pH of 7.2, alkali treated gelatin having an isoelectric point of a pH of 5.0 and benzene sulfonyl chloride treated gelatin (synthesized by the method described in Japanese Patent Application No. 18624/1973) as binders in the ratio described in Table 6, mucochloric acid as a hardening agent in an amount of 50 mg per gram of the binders and silver bromide having an average particle size of 1.5 μ as a matting agent in an amount of 30 mg per gram of the binders, which was applied so as to be a film thickness of 1 μ after drying. Thus, Samples 18, 19, 20, 21 and 22 were produced.

Table 6

| Sample | Binder: Acid Treated Gelatin | Binder: Alkali Treated Gelatin | Binder: Benzene Sulfonyl Chloride Treated Gelatin |
|---|---|---|---|
| 18 | 80 | 0 | 20 |
| 19 | 70 | 10 | 20 |
| 20 | 60 | 20 | 20 |
| 21 | 40 | 40 | 20 |
| 22 | 0 | 80 | 20 |

The emulsion layer was formed using mucochloric acid as a hardening agent in an amount of 50 mg per gram of gelatin and 1-phenyl-5-mercaptotetrazole as a stabilizing agent in an amount of 5 mg per gram of gelatin, and applying silver iodobromide containing 1.5 mol% iodide in a coverage of 2.4 g/m² of gelatin and 5.00 g/m² of silver. The adhesion test was carried out in the same manner as in Example 1. But in this example, the protective layers of each sample were subjected to adhesion testing because the sample had two coating surfaces. Further, the close adhesion test was carried out on samples after storage at a temperature of 25° C and a humidity of 60% for 7 days. Samples were subjected to the following development, fixation and water washing, processing and the friction resistance at development and water washing were determined as in Example 1.

| | |
|---|---|
| Developing Solution | |
| Sodium Sulfite | 40 g |
| Hydroquinone | 25 g |
| Boric Acid | 10 g |
| 1-Phenyl-3-pyrazolidone | 1.5 g |
| Potassium Hydroxide | 30 g |
| 5-Methylbenzotriazole | 0.15 g |
| Glutaraldehyde Bisulfite | 15 g |
| Acetic Acid | 12 g |
| Potassium Bromide | 5 g |
| Water to make | 1 liter |
| Fixing Solution | |
| Ammonium Thiosulfate | 174 g |
| Sodium Sulfite (anhydrous) | 20 g |
| Sodium Tetraborate (decahydrate) | 20 g |
| Acetic Acid | 25 g |
| Sulfuric Acid | 5 g |
| Aluminium Sulfate | 7 g |
| Water to make | 1 liter |

The treating temperature was 35° C, and the treating time was 25 seconds for development, 25 seconds for fixation and 20 seconds for water washing. The friction resistance was evaluated according to the following criteria.

| Grade | Condition |
|---|---|
| A | Holes were easily made on the protective layer using a steel pen and the protective layer easily came off from the emulsion layer. |
| B | Holes were made on the protective layer using a steel pen, but peeling off from the emulsion layer was somewhat difficult. |
| C | No holes were made using a steel pen and peeling off was not observed. |

The results of determinations of adhered areas and the friction resistance of Samples 18 to 22 are shown in Table 7.

Table 7

| Sample | Adhered Area (%) | Friction Resistance | |
|---|---|---|---|
| | | Development | Water Washing |
| 18 | 20 | B | A |
| 19 | 20 | C | C |
| 20 | 30 | C | C |
| 21 | 40 | C | C |
| 22 | 90 | C | C |

It can be understood from the results in Table 7 that photosensitive materials having an excellent anti-adhesive property and excellent close adhesion can be obtained if acid treated gelatin is used together with alkali treated gelatin.

EXAMPLE 4

To a cellulose triacetate support having a subbing layer, a red-sensitive silver halide emulsion layer, and an intermediate layer which contained the additives described in Table 1 were applied simultaneously using an apparatus similar to that described in FIG. 10 of U.S. Pat. No. 2,761,791. After drying at 25° C and 60% relative humidity, it was wound on a reel having a diameter of 10 cm. In this manner, Samples 23, 24 and 25 were produced, wherein gelatin in the intermediate layer of each sample was composed of acid treated gelatin and alkali treated gelatin of Example 1 in a weight ratio of 100:0, 80:20 or 0:100 respectively. The rolled samples were stored at a temperature of 25° C and a relative humidity of 60% for 1 week. Then the sample was unwound and adhered areas near the reel were examined. No adhered areas were observed in Samples 23 and 24, while adhered areas were remarkably observed in Sample 25. Further, a green-sensitive silver halide emulsion layer, a yellow filter layer, a blue-sensitive silver halide emulsion layer and a surface layer which were the same as in Sample 3 were formed on the above described unfinished samples, that is Samples 23, 24 and 25, by applying the green-sensitive silver halide emulsion layer and the yellow filter layer and drying these two layers followed by applying the blue-sensitive silver halide emulsion layer and the surface layer and drying these two layers to produce Samples 26, 27 and 28. After storage at a temperature of 25° C and a relative humidity of 60% for 7 days, close adhesion testing was carried out. Good results were obtained for Samples 27 and 28, but separation between the intermediate layer and the green-sensitive silver halide emulsion layer easily occured in Sample 26.

It can be understood from the above described results that the anti-adhesive property of the unfinished products is improved if acid treated gelatin in used together with alkali treated gelatin in the surface layer of the unfinished products, and thus photosensitive materials having good close adhesion can be obtained.

EXAMPLE 5

A yellow filter layer was applied in the same manner as in Example 4 but acid treated gelatin and alkali treated gelatin were used. When the adhesion test and the close adhesion test were carried out, the same results as in Example 4 were obtained.

In the case of using binders, matting agents or hardening agents other than those used in Examples 1 to 5, similar excellent results could be also obtained.

While the invention has been described in detail and with reference to specific embodiments thereof, it will be apparent to one skilled in the art that various changes and modifications can be made therein without departing from the spirit and scope thereof.

What is claimed is:

1. A silver halide photographic sensitive material comprising a support and at least one light-sensitive silver halide emulsion layer and with a surface layer located on the same side of the support as the light-sensitive silver halide emulsion layers and containing gelatin produced by processing collagen in acid and gelatin produced by processing collagen in alkali, in a ratio by weight of the gelatin produced by processing collagen in alkali to the gelatin produced by processing collagen in acid of about 0.5% or more but less than 100%, the total of the gelatin produced by processing collagen in acid and the gelatin produced by processing collagen in alkali in said surface layer being greater than about 20% by weight of the total weight of the binder in the surface layer, said surface layer not being a light-sensitive layer.

2. The silver halide photographic sensitive material of claim 1, wherein two or more other layers contain a mixture of gelatin produced by processing collagen in alkali gelatin produced by processing collagen in acid.

3. The silver halide photographic sensitive material of claim 1, wherein said gelatin produced by processing collagen in acid has an isoelectric point of a pH of about 6.0 to 9.5 and said gelatin produced by processing collagen in alkali has an isoelectric point of a pH of about 4.5 to 5.3.

4. The silver halide photographic sensitive material of claim 1, wherein said gelatin produced by processing collagen in acid has an isoelectric point of a pH of about 6.0 to 9.5 and said gelatin produced by processing collagen in alkali has an isoelectric point of a pH of about 4.5 to 5.3.

5. The silver halide photographic sensitive material of claim 1, wherein a layer adjacent said surface layer contains gelatin produced by processing collagen in alkali.

6. The silver halide photographic sensitive material of claim 2, wherein a layer adjacent said surface layer contains gelatin produced by processing collagen in alkali.

7. The silver halide photographic sensitive material of claim 1, wherein said surface layer contains a matting agent.

8. The silver halide photographic sensitive materialof claim 2, wherein said surface layer contains a matting agent.

9. The silver halide photographic sensitive material of claim 7, wherein said matting agent has an average particle size of about 0.3 microns to 5 microns.

10. The silver halide photographic sensitive material of claim 8, wherein said matting agent has an average particle size of about 0.3 microns to 5 microns.

11. The silver halide photographic sensitive material of claim 1, wherein said surface layer includes a gelatin hardening agent.

12. The silver halide photographic sensitive material of claim 2, wherein said surface layer includes a gelatin hardening agent.

13. The silver halide photographic sensitive material of claim 1, wherein the proportion of gelatin produced by processing collagen in alkali ranges from about 5 to 80% of the amount of the gelatin produced by processing collagen in acid.

14. The silver halide photographic semsitive material of claim 2, wherein the proportion of gelatin produced by processing collagen in alkali ranges from about 5 to 80% of the amount of the gelatin produced by processing collagen in acid.

* * * * *